US005943952A

United States Patent [19]

Monti

[11] Patent Number: 5,943,952

[45] Date of Patent: Aug. 31, 1999

[54] CALENDER FOR THE SUBLIMATIC THERMOPRINTING OF FABRICS WHICH OPERATES CONTINUOUSLY OR FOR INDIVIDUAL ITEMS

[75] Inventor: Antonio Monti, Thiene, Italy

[73] Assignee: Monti Antonio S.p.A., Thiene (Vicenza), Italy

[21] Appl. No.: 09/141,274

[22] Filed: Aug. 27, 1998

[30] Foreign Application Priority Data

Sep. 4, 1997 [IT] Italy ..... VI97A0149

[51] Int. Cl.[6] ..... B41D 7/00

[52] U.S. Cl. ..... 101/33; 271/245; 242/615

[58] Field of Search ..... 101/33, 34, 470; 271/245, 189; 226/196.1; 242/615.21, 615

[56] References Cited

U.S. PATENT DOCUMENTS

| | | | |
|---|---|---|---|
| 3,689,350 | 9/1972 | Renaut | 156/540 |
| 3,880,579 | 4/1975 | Renaut | 101/470 X |
| 4,117,699 | 10/1978 | Renaut | 101/470 X |
| 4,151,033 | 4/1979 | Metzger | 101/470 X |
| 4,178,782 | 12/1979 | Schiffer | 101/470 X |
| 4,281,598 | 8/1981 | Rump | 101/470 |
| 5,147,092 | 9/1992 | Driscoll et al. | 271/198 X |
| 5,244,200 | 9/1993 | Manzke | 271/198 |
| 5,493,966 | 2/1996 | Tseng | 101/33 X |
| 5,797,316 | 9/1998 | Park | 100/33 |

*Primary Examiner*—Edgar Burr
*Assistant Examiner*—Minh H. Chau
*Attorney, Agent, or Firm*—Bucknam and Archer

[57] ABSTRACT

The calender for the sublimatic thermoprinting of fabrics which operates continuously or for individual items has a calendering group (1) which is provided in the front part with positioning plane (2) on which the printing paper (3) and the fabric (4) are placed. In front of the plane are located bobbins on which are wound respectively the printing paper (3), the fabric (4) and the protection paper (5). Downstream of the calendering group is located a transfer belt (6) and bobbins for the rewinding respectively of the exhausted printing paper (3'), the fabric (4') and the protection paper (5').

6 Claims, 2 Drawing Sheets

CALENDER FOR THE SUBLIMATIC THERMOPRINTING OF FABRICS WHICH OPERATES CONTINUOUSLY OR FOR INDIVIDUAL ITEMS

FIELD OF THE INVENTION

The present invention falls in the field of calenders for the sublimatic thermoprinting of fabrics. The calender of the present application may operate both continuously or for individual items.

BACKGROUND OF THE PRIOR ART

It is known that the operation of sublimatic thermoprinting of fabrics consists of transferring from a paper support to a fabric drawings made with coloring materials so that under special temperature conditions they undergo the sublimation process, that is they are transferred directly from the solid state to the vapor state and rapidly they recondense again to the solid state.

At the present state of the art two types of machines are employed for the sublimatic thermoprinting: they are the calender and the press. The calender is employed for the thermoprinting in a roll called "in rotolo" in which the printing paper and also the fabric are unwound from respective bobbins, go through rollers continuously to a reciprocal contact in order to achieve the transfer of the drawings by sublimation. This manner of operation is utilized for the thermoprinting of repetitive designs which does not require a particular position on the fabric such as for instance designs for fabric with lines and similar designs.

The press is used for the thermoprinting of pieces of pre-cut material with designs placed or not placed and substantially is constituted by a fixed plane and a mobile cover between which are placed in reciprocal contact, the piece of the fabric to be printed with the corresponding printed sheet, in order to achieve the transfer of designs by sublimation.

SUMMARY OF THE INVENTION

The object of the invention is the achievement of a machine which utilizing the manner of operation of a calender permits to achieve an operation of polyvalent sublimatic printing, that is which is valid under the following conditions:

- printing paper in a roll; the fabric in a roll;
- printing paper in a roll; the fabric in the form of pre-cut pieces;
- printing paper in separate sheets; the fabric in the form of pre-cut pieces.

This is accomplished essentially by providing a machine constituted by a group of sublimatic thermoprinting of the calender type, this group being provided in the front part with a positioning plane on which are placed in reciprocal contact, the printing paper together with the fabric and in front of this plane are placed the eventual bobbins from which the products are unwound.

From the constructive point of view the machine of the invention, called hereinbelow with a generic term "calandra" offers novel solutions so that it is particularly advantageous from the point of view of productivity and economical operation. A first advantage is constituted by the fact that the positioning plane on which the printing paper runs, the latter being in the form of a roll or on which a separate sheet of the printing paper is placed, with the drawings being turned upwardly, is cold and is not kept at the temperature of 180°–215° C. as it is done for the planes of the presses of normal utilization so that substantial safety for the operator is achieved.

Also on the positioning plane are located some lateral rods which are adjustable for the transversal centering of the printing paper in the form of a sheet and are also placed support pins which are retractable for the frontal lining of the same sheet. The correct positioning of the individual pieces of the fabric on top of the printing paper, both if the printing paper is in the form of a roll or if it is in the form of a separate sheet, is accomplished by means of small headlights which are placed on top of the positioning plane, the headlights functioning as optical layers showing to the operator visual reference points where to place in an orderly fashion the individual pieces of the fabric to be thermoprinted.

Another novel feature of the invention resides in the fact that it comprises a device provided with elastic structures and air blowers which guarantee a regular introduction into the calendering group of the printing paper together with the fabric and with an upper layer of a protective paper in a roll.

Finally after the thermoprinting phase is completed the separation of the individual piece of exhausted printing paper is provided in two different manners depending whether the paper contains glue or less glue or no glue at all. Specifically, during the operation with printing paper which contains some glue the separation of the individual pieces is carried out manually in the rear part of the machine prior to the phase of rolling of exhausted paper. On the contrary, during the operation with printing paper which does not contain glue the individual pieces are placed on top of a transport belt while the exhausted paper is removed in the front part of the machine by means of a suitable chute for the separation.

BRIEF DESCRIPTION OF THE DRAWINGS

These and other characteristics of the invention are described hereinbelow in detail by reference to a possible embodiment of the invention which is provided by way of example and is not intended to be limiting, by reference to the accompanying drawings of which:

As shown in FIG. 1, the calender of the invention is substantially constituted by a calendering group (1), known per se, provided in the front part with fixed positioning plane (2).

Figure 1:
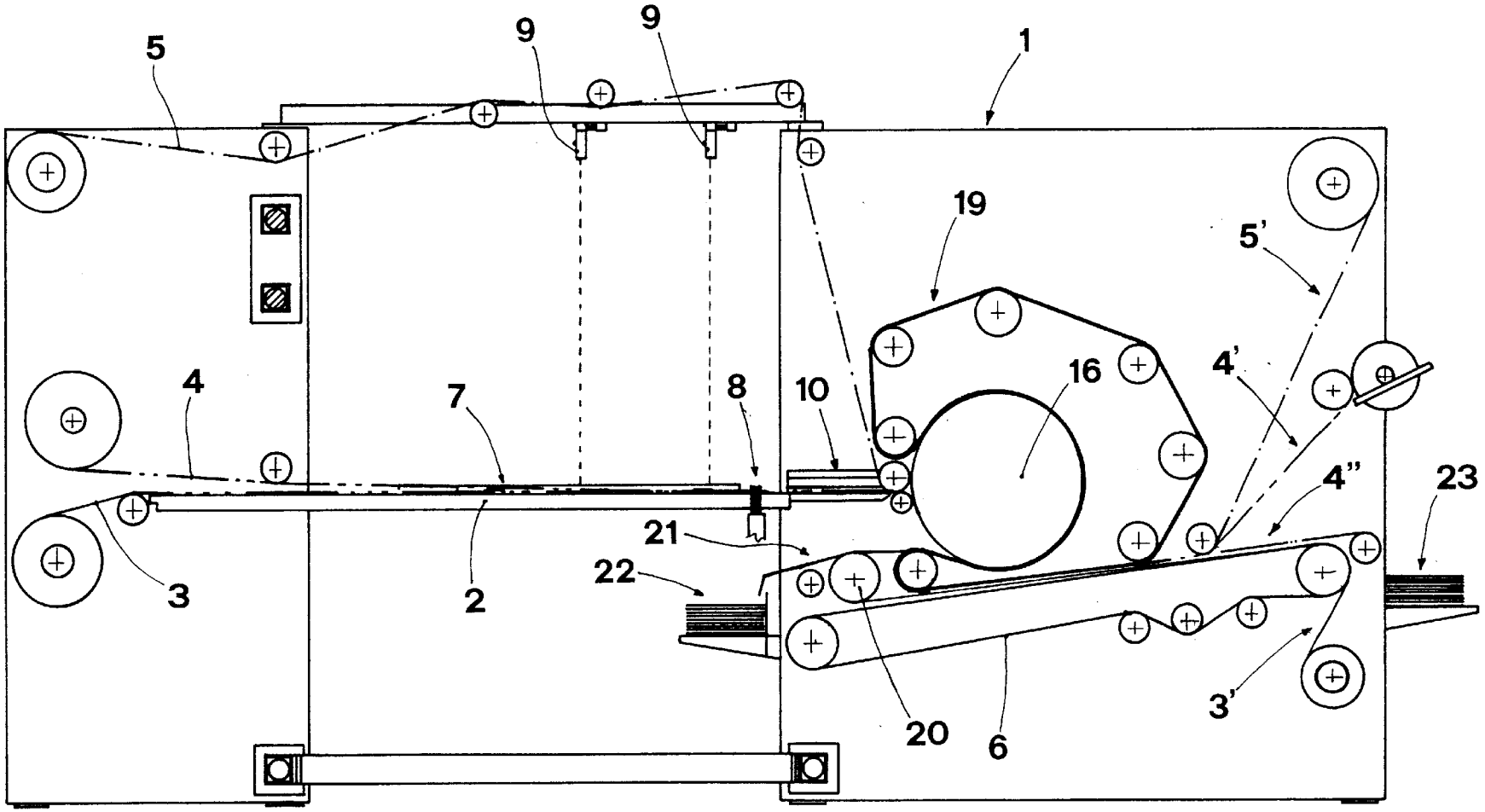
FIG. 1 shows an elevational schematic view of the calender of the invention.

In front of the positioning plane are placed the bobbins on which are wound respectively the printing paper (3), the fabric (4) to be printed and the protection paper (5).

The calender of the invention is completed with the transfer belt (6) for the exit and the bobbins on which are respectively rewound the exhausted printing paper (3'), the printed fabric (4') and the protection paper (5').

Obviously if one operates with printing paper in the form of a roll and with fabric as pre-cut pieces, the bobbin for winding the fabric (4') is empty. Analogously when one operates under the conditions of printing paper in the form of separate sheets and a fabric in the form of pre-cut pieces also bobbin (3') is empty. Under these latter conditions of operation the operator manually provides for positioning on plane (2) first the single sheet of printing paper with the drawings turned upwardly and then with the individual pieces of fabric to be printed on top of the sheet of paper.

The transversal centering of the individual sheet of paper is carried out by means of lateral rods (7) which are anchored on plane (2), preferably by means of magnets while the frontal lining-up is achieved by means of support pins (8) which protrude from the same plane.

The correct positioning by the operator of the individual pieces on top of the printing paper in such a manner that the drawings are impressed exactly on the piece of fabric is achieved by means of the light features (9) which are properly oriented and they act as optical layers on the positioning plane.

Figure 2:
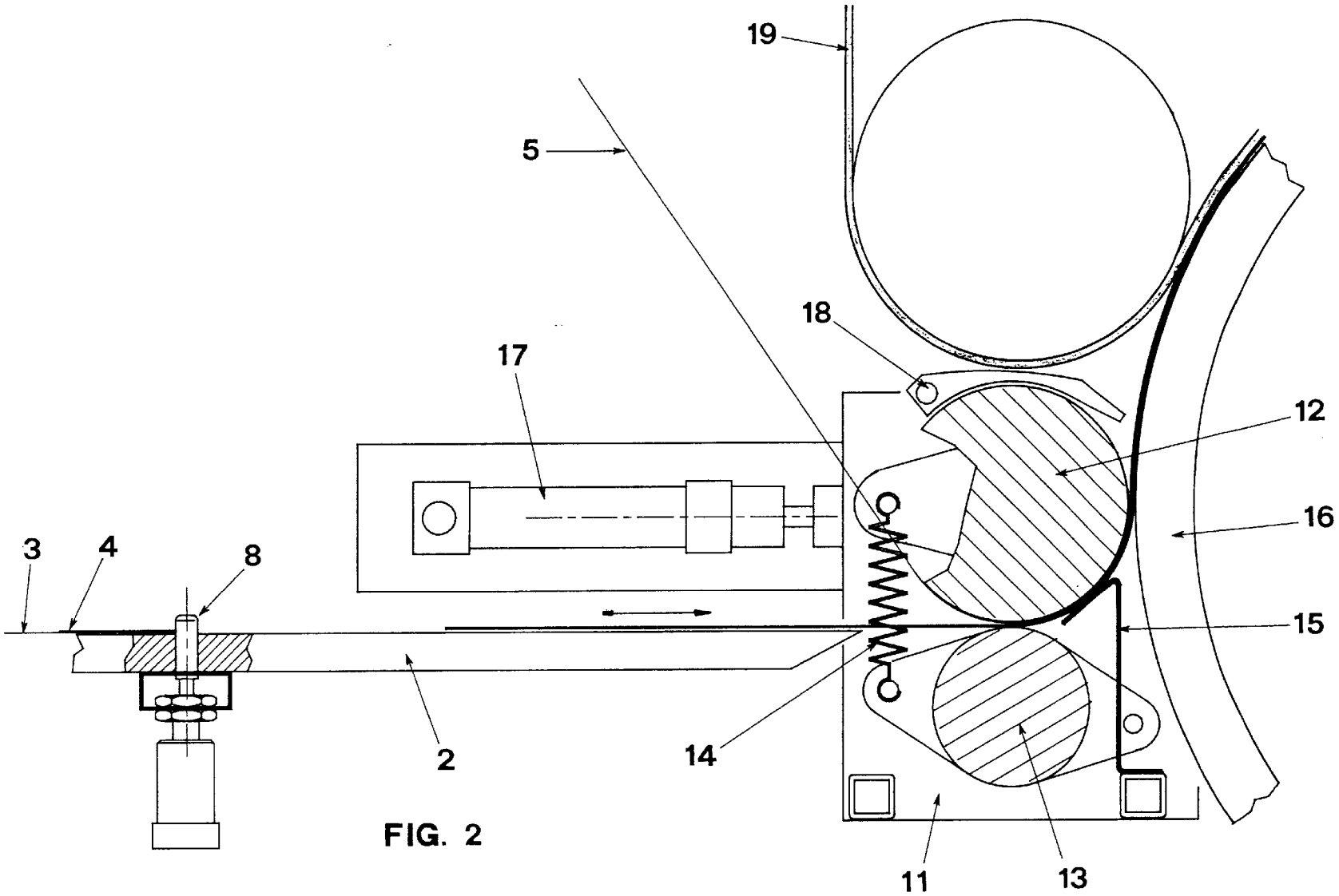
FIG. 2 illustrates in detail the part of the introduction to the calendering group.

As shown in FIG. 2 the device (10) which ensures a regular introduction into the calendering group (1) is constituted by a structure (11) which supports two transversal rollers (12) and (13) one superimposed over the other between which the film composed by the three layers connected one to the other, that is the printing paper (3), the fabric (4) and the protection paper (5) runs through and where the lower roller (13) is elastically anchored due to the contrasting spring (14) to the upper roller (12).

The elastic lamina (15) is provided to maintain the film adhering to the upper roller (12) while the contact between this deviating roller and the printing cylinder (16) is maintained by letting the entire structure (11) run longitudinally by means of pneumatic cylinders (17) which are laterally located. In addition in order to maintain the protection paper (5) in contact with the fabric (4) there is provided the use of an air blower (18) which is placed in operation immediately at the exit of the upper roller (12) and prior to the time when the film is dragged by felt (19).

Finally in the operation with printing paper with separate sheets of the type without glue the individual printed pieces are located on the transport belt (6) by means of transmission roller (20) so that they can be removed while the exhausted sheets of printing paper are deposited in a front part by means of a separation chute (21), the latter being preferably provided with a blow of air so that pile (22) is formed.

On the contrary, if the paper which is exhausted is provided with a glue, the separation of the individual pieces is carried out manually prior to the time individual sheets (4") are deposited in the rear part thus forming pile (23).

What is claimed is:

1. A calender for the sublimatic thermoprinting of fabrics which operates both continuously or for each individual item, which comprises a calendering group (1), a positioning plane (2), said positioning plane (2) being provided upstream of said calendering group (1), printing paper (3), fabric (4), said printing paper and said fabric being placed on said positioning plane (2), bobbins being located upstream of said plane (2), protection paper (5), said printing paper (3), said fabric (4) and said protection paper (5) being wound respectively on said bobbins, a transport belt (6), said transport belt and said bobbins being located downstream of said calendering group, said bobbins providing respectively for the rewinding of the printing paper (3'), printed fabric (4') and protection paper (5'), and the calender includes means for transversal centering, said means including lateral rods (7), said lateral rods being anchored on said positioning plane (2) and said transversal centering is achieved by means of said lateral rods (7).

2. The calender according to claim 1, wherein said anchoring of said lateral rods (7) on said positioning plane is obtained with magnetic means.

3. The calender according to claim 1, wherein said printing paper, said protection paper and said fabric combine to form a film and said film is introduced in said calendering group (1), said film being multilayer, wherein the calender comprises a device (10) for the introduction of said multilayer film into said calendering group (1), and said calender comprises two transversal rollers (12) and (13), said rollers being parallel and one superimposed over the other, said rollers being placed in elastic contact by means of spring (14).

4. The calender according to claim 3, which comprises an elastic lamina (15), said roller (12) being above said roller (13), said lamina (15) maintaining said multilayer film in contact with said upper roller (13).

5. The calender according to claim 3, which comprises printing cylinder (16), pneumatic cylinders (17), said roller (12) being a deviating roller, and said device (10) is capable of sliding longitudinally by means of said pneumatic cylinders (17) whereby continuous contact between said roller (12) and said printing cylinder (16) is obtained.

6. The calender according to claim 3, which comprises a felt (19) and an air blower (18), said air blower maintaining said protection paper (5) pressing on said fabric (4) in the area located upstream of the mouth of the roller (12) prior to the time when said film is dragged by said felt.

* * * * *